US010941791B1

(12) United States Patent
Ehrnberg

(10) Patent No.: US 10,941,791 B1
(45) Date of Patent: Mar. 9, 2021

(54) FLUID FLOW CONVERTER

(71) Applicant: Spira Energy AB, Steninge (SE)

(72) Inventor: Daniel Ehrnberg, Steninge (SE)

(73) Assignee: SPIRA ENERGY AB, Steninge (SE)

( * ) Notice: Subject to any disclaimer, the term of this patent is extended or adjusted under 35 U.S.C. 154(b) by 0 days.

(21) Appl. No.: 16/957,713

(22) PCT Filed: Feb. 1, 2019

(86) PCT No.: PCT/SE2019/050088

§ 371 (c)(1),
(2) Date: Jun. 24, 2020

(87) PCT Pub. No.: WO2019/151935

PCT Pub. Date: Aug. 8, 2019

(30) Foreign Application Priority Data

Feb. 1, 2018 (SE) ..... 1850116-3

(51) Int. Cl.
*F15B 15/08* (2006.01)
*F15B 15/02* (2006.01)
*F03B 13/00* (2006.01)

(52) U.S. Cl.
CPC ..... *F15B 15/088* (2013.01); *F03B 13/00* (2013.01); *F15B 15/02* (2013.01)

(58) Field of Classification Search
CPC ..... F15B 15/02; F15B 15/06; F15B 15/088; F03B 13/00; F03B 13/10; F03B 17/061
See application file for complete search history.

(56) References Cited

U.S. PATENT DOCUMENTS 2,837,062 A * 6/1958 Thorpe ..... F15B 15/06 91/15
4,086,764 A * 5/1978 Brown ..... F03B 13/00 60/325
4,816,697 A * 3/1989 Nalbandyan ..... F03B 17/061 290/54
4,820,134 A 4/1989 Karlsson
5,366,341 A * 11/1994 Marino ..... F03B 13/1815 415/6

(Continued)

FOREIGN PATENT DOCUMENTS

DE 10231008 1/2004
FR 2454007 11/1980

(Continued)

*Primary Examiner* — Michael Leslie
(74) *Attorney, Agent, or Firm* — Babcock IP, PLLC

(57) ABSTRACT

An apparatus for converting rotation to fluid flow, comprising a fluid conduit coiled around a rotational axis, the fluid conduit having a first inlet for receiving first fluid having a first density and a second inlet for receiving second fluid having a second density, and a first outlet for output of first fluid and a second outlet for output of second fluid; a motor coupled to the fluid conduit to rotate the fluid conduit around the rotational axis in a first angular direction such that first fluid portions of first fluid and second fluid portions of second fluid are transported along the fluid conduit towards the first outlet, while being pressurized; and a fluid returning arrangement, fluid flow connecting the second outlet and the second inlet for selectively allowing pressurized second fluid to return from the second outlet to the second inlet, while depressurizing the pressurized second fluid.

15 Claims, 5 Drawing Sheets

(56) References Cited

U.S. PATENT DOCUMENTS

| | | | | |
|---|---|---|---|---|
| 6,355,988 | B1 * | 3/2002 | Maple | F03B 17/005 290/54 |
| 7,299,628 | B2 | 11/2007 | Buller | |
| 9,759,180 | B2 * | 9/2017 | Russo | F04D 3/02 |
| 10,364,830 | B2 * | 7/2019 | Ehrnberg | F03B 17/061 |
| 2012/0117960 | A1 | 5/2012 | Browne | |

FOREIGN PATENT DOCUMENTS

| | | |
|---|---|---|
| GB | 1422723 | 3/1976 |
| WO | 2016080902 | 5/2016 |

* cited by examiner

FLUID FLOW CONVERTER

FIELD OF THE INVENTION

The present invention relates to an apparatus and method for converting rotation into fluid flow, and to an apparatus and method for converting fluid flow into rotation.

BACKGROUND OF THE INVENTION

It has long been known to pump water or compress air using a device relying on alternatingly admitting air and water into a coiled pipe, which is rotated around an axis of rotation. Such a device has few moving parts, and is considered to be relatively simple and reliable.

For instance, GB 1 427 723 discloses an apparatus for pumping fluids, which comprises a pipe of constant cross-section disposed around a cylindrical structure in a number of turns so as to form a cylindrically shaped coil. One end of the coiled pipe is connected to a hollow shaft of the apparatus, while the other end of the coiled pipe terminates at the periphery of the cylindrical structure and is open to the atmosphere. When the cylindrical structure is rotated, water and air are alternatingly admitted to the open end of the pipe and transported to the hollow shaft.

More energy-efficient apparatuses are disclosed by WO 2016/080902, where, according to embodiments, one coiled fluid conduit—a pressure-increasing fluid conduit—is used to achieve a gradual increase in pressure of first and second fluid, and one coiled fluid conduit—a pressure-decreasing fluid conduit—is used to return first and second fluid, while achieving a gradual decrease in pressure.

There appears to still be room for improvement. In particular, it would be desirable to provide for a more compact and/or cost-efficient apparatus for converting rotation into fluid flow and/or converting fluid flow into rotation.

SUMMARY

In view of the above, it is an object of the present invention to provide for improved conversion of rotation into fluid flow and/or improved conversion of fluid flow into rotation.

According to a first aspect of the present invention, it is therefore provided an apparatus for converting rotation to fluid flow, comprising: a fluid conduit coiled around a rotational axis, the fluid conduit having a first inlet for receiving first fluid having a first density and a second inlet for receiving second fluid having a second density, different from the first density, and a first outlet for output of the first fluid and a second outlet for output of the second fluid; a motor coupled to the fluid conduit to rotate the fluid conduit around the rotational axis in a first angular direction such that first fluid portions of the first fluid and second fluid portions of the second fluid are transported along the fluid conduit towards the first outlet, while being pressurized; and a fluid returning arrangement, fluid flow connecting the second outlet and the second inlet for selectively allowing pressurized second fluid to return from the second outlet to the second inlet, while depressurizing the pressurized second fluid.

A fluid is any substance that flows. Accordingly, fluids include, for example, gases, liquids, and, for instance, solid particles suspended in a liquid to form a particle suspension exhibiting fluid behavior.

It should be understood that the first inlet and the second inlet may be provided as different separate inlets, or as a common inlet. Analogously, the first outlet and the second outlet may be provided as different separate outlets, or as a common outlet.

The fluid conduit does not necessarily have to be a coiled tube, but can be configured in many other ways, as long as the fluid path is coiled, so that a projection of the fluid path forms a spiral.

When a first fluid and a second fluid having different densities are both present inside a coiled fluid conduit, the equilibrium state for the coiled fluid conduit, when stationary and without a pressure differential, will be with the combined center of mass of the first and second fluids directly below the axis of rotation for the coiled fluid conduit. When the coiled fluid conduit is rotated against a pressure head the combined center of mass shifts along the coiled fluid conduit corresponding to the gradually increased pressure inside the coiled fluid conduit. The shifted combined center of mass in the pressure-increasing coiled fluid conduit will exert a torque on the coiled fluid conduit. A greater torque of opposite sign than this mass center shift induced torque will need to be provided (by the motor) to the pressure-increasing coiled fluid conduit to maintain rotation.

To transport first fluid from the first inlet to the first outlet, while maintaining closed-circuit operation in respect of second fluid, the present inventor has realized that it would be desirable to provide a fluid returning arrangement that fluid flow connects the second outlet and the second inlet, and is configured to selectively allow pressurized second fluid to return to the second inlet, while depressurizing the pressurized second fluid.

That the fluid returning arrangement is configured to selectively allow pressurized second fluid to return should be understood to mean that the fluid returning arrangement is configured to prioritize the return of pressurized second fluid over any return of pressurized first fluid. For instance, the fluid returning arrangement may be configured to keep the volume proportion of pressurized second fluid passing from the fluid conduit to the fluid returning arrangement, at the second outlet, above at least 80%. Advantageously, the fluid returning arrangement may be configured to keep this volume proportion above 90%.

According to various embodiments, the fluid returning arrangement may comprise a pressure reducing arrangement including an actuator, the pressure reducing arrangement being configured to: receive the pressurized second fluid; cause the pressurized second fluid to perform work on the actuator, resulting in movement of the actuator, to thereby be depressurized; and output depressurized second fluid.

The fluid returning arrangement may comprise a fluid returning conduit, and the actuator may be arranged to move in relation to the fluid returning conduit as a result of interaction with the second fluid.

The pressure reducing arrangement may be any arrangement that can convert pressure reduction to work. Examples of suitable pressure reducing arrangements include turbines, pumps, and pistons.

The above-mentioned actuator may be a linear actuator, such as a piston, or a rotary actuator, such as a shaft.

Through the provision of the pressure reducing arrangement, the energy released when the pressurized second fluid is depressurized can be used by exploiting the movement of the actuator.

According to embodiments, a conversion arrangement may be coupled to the actuator and configured to convert the movement of the actuator to rotation of the fluid conduit in the first angular direction. The conversion arrangement may be mechanically coupled to the fluid conduit, or the conversion arrangement may include an electric generator, in which the above-mentioned actuator is coupled to the rotor to cause the electric generator to generate electricity, which may be used to help drive the rotation of the fluid conduit around the rotational axis in the first rotational direction.

In some embodiments, the conversion arrangement may mechanically couple the actuator to the fluid conduit in such a way that the movement of the actuator results in rotation of the fluid conduit in the first angular direction.

According to a second aspect of the present invention, there is provided an apparatus for converting rotation to fluid flow, comprising: a fluid conduit coiled around a rotational axis, the fluid conduit having a first inlet for receiving first fluid having a first density and a second inlet for receiving second fluid having a second density, different from the first density, and a first outlet for output of the first fluid and a second outlet for output of the second fluid, the fluid conduit being rotatable around the rotational axis in a first angular direction such that first fluid portions of the first fluid and second fluid portions of the second fluid are transported along the fluid conduit towards the first outlet, while being pressurized; and a fluid returning arrangement, fluid flow connecting the second outlet and the second inlet for selectively allowing pressurized second fluid to return from the second outlet to the second inlet, while depressurizing the pressurized second fluid, wherein the fluid returning arrangement comprises a pressure reducing arrangement including an actuator, the pressure reducing arrangement being configured to: receive the pressurized second fluid; cause the pressurized second fluid to perform work on the actuator, resulting in movement of the actuator, to thereby be depressurized; and output depressurized second fluid, wherein the apparatus further comprises a conversion arrangement coupled to the actuator and configured to convert the movement of the actuator to rotation of the fluid conduit in the first angular direction.

It should be understood that the following description and explanations of different embodiments of the present invention apply to all aspects of the present invention.

According to embodiments, a first flow-control device may be arranged to control fluid flow between the fluid conduit and the fluid returning arrangement through the second outlet. By means of the first flow-control device, which may be a first controllable valve, second fluid may be taken from the fluid conduit through the second outlet only during selected time periods. This may provide for more efficient operation of the apparatus according to the different aspects of the present invention.

The first flow-control device may be a controllable valve, such as a controllable check valve. The first flow-control device may be mechanically or electrically controllable. It should be noted that the first flow-control device does not have to be arranged at the second outlet, but could be arranged at another location between the second outlet and the second inlet, as long as it is controllable to prevent or allow fluid flow through the second outlet.

According to embodiments, the first flow-control device may be an electrically controllable flow-control device; and the apparatus may further comprise control circuitry having an input for receiving a signal indicative of an angular position of the second outlet, and at least a first output for providing a first control signal to the flow-control device to allow flow from the fluid conduit through the second outlet to the fluid returning arrangement only when the second outlet is within a predetermined first angular range.

The signal indicative of the angular position may, for example, come from an angle sensor comprised in the apparatus.

Alternatively, the first flow-control device may be mechanically controllable, for example by a cam structure, and the apparatus may comprise a mechanical structure (cam structure) arranged to control the flow-control device to allow flow from the fluid conduit through the second outlet to the fluid returning arrangement only when the second outlet is within a predetermined first angular range.

According to various embodiments, furthermore, the fluid conduit may further have a third outlet, arranged along the fluid conduit between the second inlet and the second outlet, for output of second fluid; and the fluid returning arrangement may be fluid flow connect the third outlet and the second inlet for selectively allowing pressurized second fluid to return from the third outlet to the second inlet, while depressurizing the pressurized second fluid.

The provision of the third outlet allows return of second fluid from an additional position along the fluid conduit, which provides for more efficient operation and/or allows for the use of a longer fluid conduit and/or a higher pressure and/or compression ratio of the first fluid at the first outlet.

Advantageously, the apparatus of the different aspects of the invention may further comprise a second flow-control device arranged to control fluid flow between the fluid conduit and the fluid returning arrangement through the third outlet.

Furthermore, the fluid conduit may have a third inlet for receiving second fluid, and a third outlet for output of second fluid; and the fluid returning arrangement may fluid flow connect the third outlet and the third inlet for selectively allowing pressurized second fluid to return from the third outlet to the third inlet, while depressurizing the pressurized second fluid.

The third inlet may be arranged along the fluid conduit between the first inlet and the second inlet. With this configuration, pressurized second fluid may be returned in steps to different locations along the fluid conduit, which provides for further improved efficiency of the apparatus.

In embodiments, the second inlet and the third outlet may be provided as a common inlet-outlet port. In such embodiments, the above-mentioned first flow-control device may advantageously be arranged to control fluid flow between the fluid conduit and the fluid returning arrangement through the common inlet-outlet port.

The apparatus may comprise a control unit connected to the first flow-control device, and configured to control the first flow-control device to allow depressurized second fluid from the second inlet to flow through the common inlet-outlet port from the fluid returning arrangement to the fluid conduit during first time periods, and to control the first flow-control device to allow pressurized second fluid to flow through the common inlet-outlet port from the fluid conduit to the fluid returning arrangement towards the third inlet during second time periods. The second time periods may be different from the first time periods.

According to various embodiments, furthermore, the first outlet and the second outlet may be provided as a common outlet; and the fluid returning arrangement may comprise a fluid separator for separating the first fluid from the second fluid.

The first and second fluids may be mutually immiscible. For instance, the first fluid may advantageously be a gas, such as air, and the second fluid may advantageously be a liquid, such as water.

According to various embodiments, the fluid conduit, starting from the first inlet may be coiled at least a first revolution and a last revolution around the rotational axis; and the first revolution may be at a greater radial distance from the rotational axis than the last revolution.

According to a third aspect of the present invention, there is provided an apparatus for converting fluid flow into rotation, comprising: a fluid conduit coiled around a rotational axis, the fluid conduit having a first inlet for receiving first fluid having a first density and a second inlet for receiving second fluid having a second density, different from the first density, and a first outlet for output of the first fluid and a second outlet for output of the second fluid, wherein the apparatus is configured in such a way that supply of pressurized first fluid portions to the first inlet and supply of pressurized second fluid portions to the second inlet causes the fluid conduit to rotate around the rotational axis and transport the first and second fluid portions towards the first outlet, while being depressurized; and wherein the apparatus further comprises a fluid returning arrangement, fluid flow connecting the first outlet and the first inlet for selectively allowing depressurized second fluid to return from the second outlet to the second inlet, while pressurizing the depressurized second fluid.

According to embodiments, the fluid returning arrangement may comprise a pressurizing arrangement including an actuator, the pressurizing arrangement being configured to: receive the depressurized second fluid; convert movement of the actuator to work acting on the second fluid to pressurize the second fluid; and output pressurized second fluid, wherein the apparatus further comprises a conversion arrangement coupled to the actuator and configured to convert rotation of the fluid conduit to movement of the actuator.

In summary, according to various embodiments the present invention relates to an apparatus for converting rotation into fluid flow and/or fluid flow into rotation. The apparatus comprises a fluid conduit coiled around a rotational axis, the fluid conduit having a first inlet for receiving first fluid having a first density and a second inlet for receiving second fluid having a second density, different from the first density, and a first outlet for output of first fluid and a second outlet for output of second fluid. The apparatus further comprises a fluid returning arrangement, fluid flow connecting the second outlet and the second inlet for selectively allowing second fluid to return from the second outlet to the second inlet.

BRIEF DESCRIPTION OF THE DRAWINGS

These and other aspects of the present invention will now be described in more detail, with reference to the appended drawings showing an example embodiment of the invention, wherein.

DETAILED DESCRIPTION OF EXAMPLE EMBODIMENTS

In the present detailed description, various embodiments of the apparatus and method according to the present invention are mainly described with reference to apparatuses for converting rotation into fluid flow and/or converting fluid flow into rotation using water as second fluid and air as first fluid.

It should be noted that this by no means limits the scope of the present invention, which equally well includes, for example, apparatuses operating using other combinations of first and second fluids having different densities. Operation with more than two different fluids is also foreseen.

Figure 1:
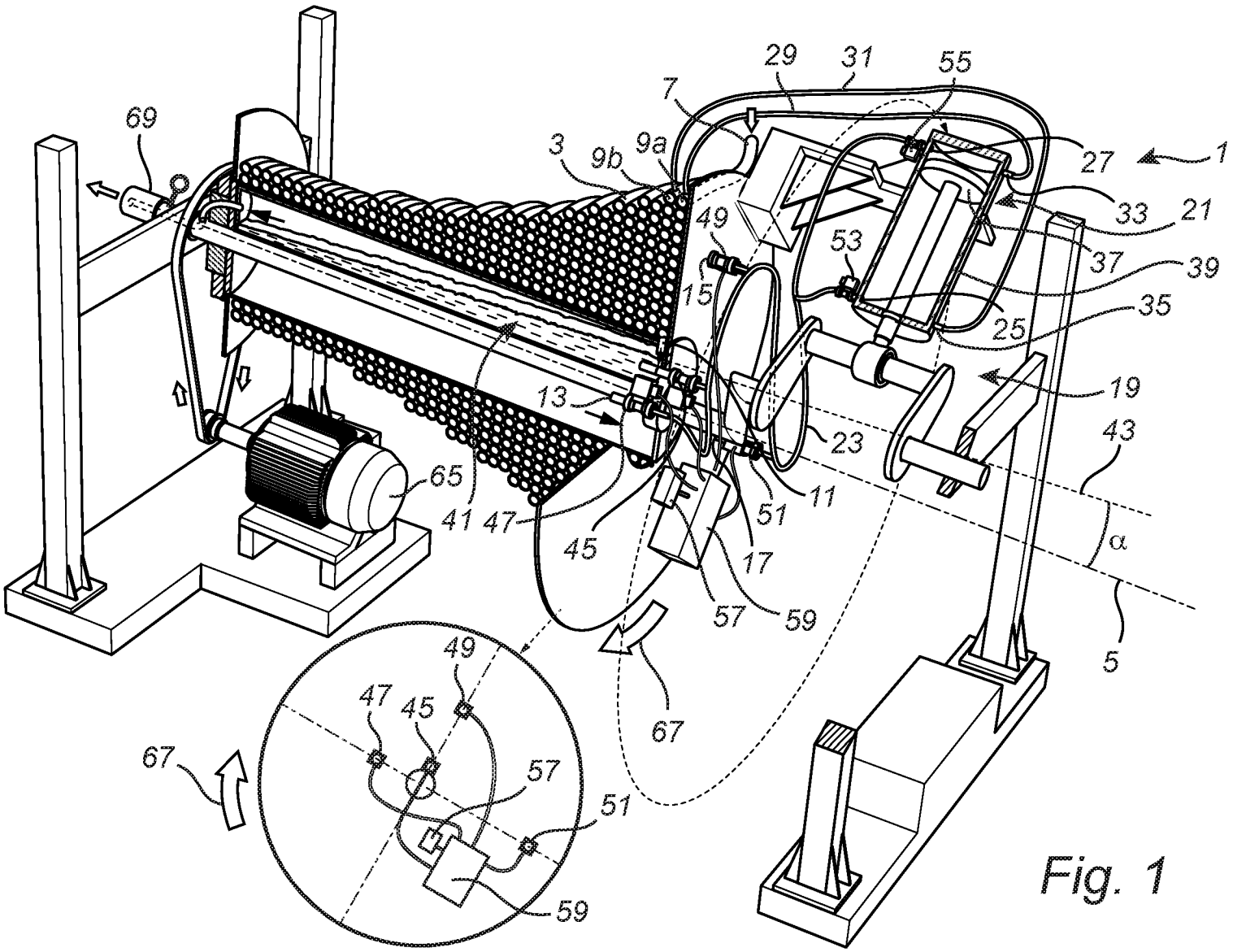
FIG. 1 is a schematic perspective view of an apparatus according to a first example embodiment of the present invention, in the form of a free-standing compressor/air motor, including a piston arrangement.

FIG. 1 schematically illustrates an apparatus according to a first example embodiment of the present invention, in the form of a free-standing compressor/air motor 1. The compressor/air motor 1 is an apparatus that can operate in two modes of operation: a first mode in which rotation is converted to fluid (air) flow; and a second mode in which flow of pressurized fluid (air) is converted to rotation.

The above-mentioned first mode of operation will be described in detail here. The above-mentioned second mode of operation simply involves running the apparatus "backwards" as compared to the first mode of operation. This means that some fluid ports that are "inlets" in the first mode will be "outlets" in the second mode, and vice versa. This also means that an electric motor in the first mode of operation is an electric generator in the second mode of operation.

The compressor/air motor 1 comprises a fluid conduit 3 coiled around a rotational axis 5. As is schematically shown in FIG. 1, the fluid conduit 3 has a first inlet 7 for receiving first fluid (here air), second inlets 9*a-b* for receiving second fluid (here water), first and second outlets here provided as a common outlet 11 for output of air and water. In the example embodiment of FIG. 1, the fluid conduit 3 additionally has a third outlet 13 for output of water, a fourth outlet 15 for output of water, and a fifth outlet 17 for output of water.

The apparatus 1 further comprises a fluid returning arrangement 19 configured to allow pressurized water to return from the outlets to the inlets, while depressurizing the pressurized water.

As can be seen in FIG. 1, the fluid returning arrangement 19 according to the example embodiment of FIG. 1 comprises a pressure reducing arrangement in the form of a piston arrangement 21, a first fluid returning conduit 23 connecting the second outlet (the common outlet 11), the third outlet 13, the fourth outlet 15, and the fifth outlet 17 with first 25 and second 27 inlets of the piston arrangement 21, and second 29 and third 31 fluid returning conduits connecting first 33 and second 35 outlets of the piston arrangement 21 with the second inlets 9*a-b*.

The piston arrangement 21 includes an actuator, in the form of a piston 37 arranged to move (non-uniformly) linearly inside a cylinder 39, between a first radial position and a second radial position further away from the rotational axis 5 than the first radial position.

The fluid returning arrangement 19 in the example apparatus 1 of FIG. 1 further comprises a fluid separator 41 arranged to receive alternate batches of pressurized air and pressurized water from the common outlet 11. By configuring the apparatus 1 so that the rotational axis 5 forms an angle $\alpha$ (a few degrees may be sufficient) with a horizontal plane 43, the pressurized air can be separated from the pressurized water, as is schematically indicated in FIG. 1.

In FIG. 1, it can also be noted that fluid separator 41 is offset from the rotational axis 5. By placing the fluid separator 41 near the inner side of the fluid conduit 3 the water and air can enter through the common outlet directly into the fluid separator 41. The centered rotor shaft that holds the rotor does not have to go through the fluid separator 41 and the fluid separator can be made smaller. This allows for a lighter apparatus, which may be important for facilitated installation, and may provide for more energy-efficient operation of the apparatus.

To allow control of the return of pressurized second fluid, the fluid returning arrangement 19 further comprises a first controllable valve 45 between the second outlet 11 and the first fluid returning conduit 23, a second controllable valve 47 between the third outlet 13 and the first fluid returning conduit 23, a third controllable valve 49 between the fourth outlet 15 and the first fluid returning conduit 23, a fourth controllable valve 51 between the fifth outlet 17 and the first fluid returning conduit 23, a fifth controllable valve 53 between the first fluid returning conduit 23 and the cylinder 39 close to the above-mentioned first radial position, and a sixth controllable valve 55 between the first fluid returning conduit 23 and the cylinder 39 close to the above-mentioned second radial position.

As is schematically indicated in FIG. 1, the second controllable valve 47, the third controllable valve 49, and the fourth controllable valve 51 are radially and angularly distributed.

To control operation of the controllable valves 45, 47, 49, 51, 53, -55, the apparatus 1 additionally includes an angle sensor 57, and a control unit 59 connected to the angle sensor 57 and to the controllable valves 45, 47, 49, 51, 53, -55, for providing control signals to the controllable valves 45, 47, 49, 51, 53, -55.

In the above-mentioned first mode of operation, the electric motor 65 rotates the first conduit 3, as well as the fluid returning arrangement 19 around the rotational axis 5 in a first angular direction 67 as is schematically indicated in FIG. 1.

When the motor 65 rotates the fluid conduit 3 around the rotational axis 5 in the first angular direction 67, batches of water and air will be transported from the first inlet 7 and the second inlets 9*a-b* towards the common outlet 11, where batches of pressurized air and pressurized water are output.

After having been output through the common outlet 11, pressurized water and pressurized air are separated in the fluid separator 41. Pressurized air can be extracted through air nozzle 69, and pressurized water is allowed to enter the first fluid returning conduit 23 through the first controllable valve 45. Depending on the angular position of the cylinder 39 of the piston arrangement 21, the fifth controllable valve 53 or the sixth controllable valve 55 will be controlled to allow the pressurized water to enter the cylinder 39 to push the piston 37 towards or away from the rotational axis 5. In the angular position of the cylinder schematically illustrated in FIG. 1, the piston 37 is maximally inserted in the cylinder 39, which means that the fifth controllable valve 53 is controlled to close, and the sixth controllable valve 55 is controlled to open, to allow the pressurized water to push the piston 37 towards the rotational axis 5, in relation to the cylinder 39. The radially directed force acting on the piston 37 is translated to torque in the first angular direction 67. The piston arrangement 21 thus assists the motor 65 in rotating the fluid conduit 3 around the rotational axis 5 in the first angular direction 67.

Water in the cylinder 39 on the other side of the piston plate (in this case on the side facing the rotational axis 5) is pushed into the second inlet 9*b* via the third fluid returning conduit 31. Due to the work done by the piston arrangement 21 acting on the fluid conduit 3 to rotate the fluid conduit 3, the water that is pushed into the second inlet 9*b* has been depressurized by the cylinder, compared to the water entering the cylinder via the first fluid returning conduit 23.

Above, return of pressurized second fluid (water) from the second outlet (common outlet 11) (having the highest pressure) was described. It is also advantageous to return pressurized water from additional outlets along the fluid conduit 3, with different and lower pressures. Accordingly, the third 13, fourth 15, and fifth 17 outlets are also fluid flow connected to the first fluid returning conduit 23, and pressurized water is allowed to pass from the fluid conduit 3 through these outlets, by controlling their respective controllable valves.

As can be readily understood, each revolution/coil of the fluid conduit 3 is partly filled with water and partly filled with air. In particular, a lower portion of each revolution/coil is filled with water. When the apparatus 1 is in operation, the water in each revolution/coil is offset due to the build up of pressure in the fluid conduit 3. This is described in detail in WO 2016/080902.

To selectively return pressurized water, the control unit 59 is configured to control the different controllable valves to open one or several flow path(s) between the fluid conduit 3 and the cylinder 39, taking into account the angular positions of the respective controllable valves.

Although not shown in FIG. 1, it may be beneficial to provide the apparatus with a temperature controlling arrangement. In the apparatus 1 in FIG. 1, such a temperature controlling arrangement may, for example, be provided in the form of a cooler arranged and configured to cool the water. This may be particularly advantageous since the apparatus 1 has a closed circuit for the water, and does not rely on an external water reservoir. The temperature controlling arrangement could for example use the outside surrounding air to cool a continuous compression process.

In an example where the apparatus is used for compression and expansion of for example air for energy storage it could be advantageous to cool the air and/or water in compression mode, converting rotation into fluid; and heat the air/or water in expansion mode, converting fluid flow into rotation. The cooling or heating source could for example come from the temperature difference between surface and bottom water in oceans and lakes or other naturally occurring temperature differences as geothermal heat in the ground and air temperature. It could also come from solar heat collector panels or from burning biofuel.

Exemplary, and somewhat simplified, control sequences for the controllable valves in the apparatus 1 in FIG. 1 will now be described with reference to FIG. 2. It should be noted that the apparatus 1 may include additional valves, that the valves may be mechanical, pneumatic or hydraulic valves, for example, and that valves need not necessarily be controlled in sequence as described herein. For instance, one or several of the valves, such as valve 45 in FIG. 1 may be controlled to open several times during one revolution of the coiled first conduit.

Figure 2:
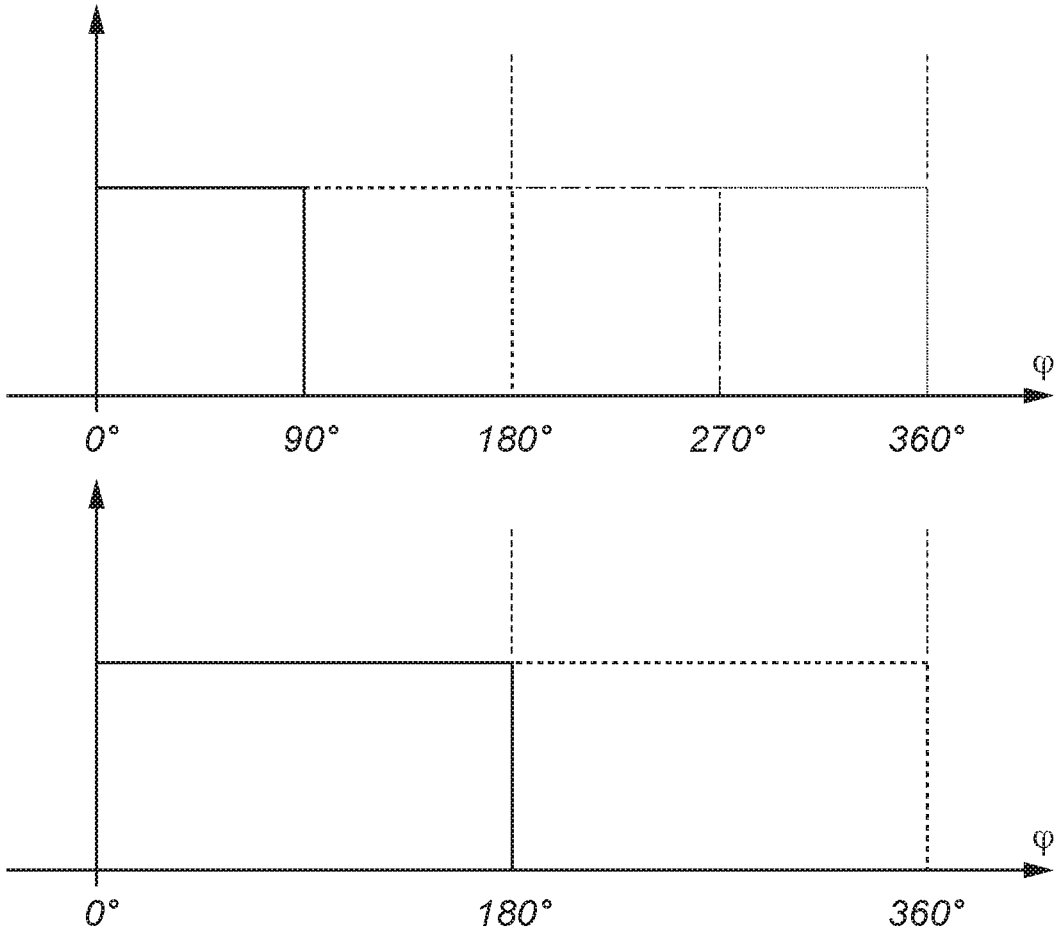
FIG. 2 is a diagram schematically illustrating example operation of the apparatus in FIG. 1.

The x-axis in FIG. 2 indicates the rotational angle $\varphi$ of the fluid conduit 3 (and the different outlets, controllable valve and piston arrangement) from 0° to 360°, and the y-axis schematically indicates control signals to the different controllable valves. The starting angle 0° is taken to represent the angular position indicated in FIG. 1, with the piston 37 maximally inserted in the cylinder 39.

From 0° to 90°, the control unit 59 controls the fourth controllable valve 51 to open to allow pressurized water to flow from the fluid conduit 3 to the first fluid returning conduit 23 through the fourth controllable valve 51. Since, as is indicated in FIG. 2, the control unit 59 controls the sixth controllable valve 55 to be open between 0° and 180°, the pressurized water exiting the fluid conduit 3 through the fourth controllable valve 51 enters the cylinder 39 through the sixth controllable valve 55 to push the piston 37 radially inwards in the cylinder 39.

From 90° to 180°, the control unit 59 controls the third controllable valve 49 to open to allow pressurized water, with higher pressure, to flow from the fluid conduit 3 to the first fluid returning conduit 23 through the third controllable valve 49, to enter the cylinder 39 through the sixth controllable valve 55 to continue to push the piston 37 radially inwards in the cylinder 39.

From 180° to 270°, the control unit 59 controls the second controllable valve 47 to open to allow pressurized water, with higher pressure, to flow from the fluid conduit 3 to the first fluid returning conduit 23 through the second controllable valve 47. Since, as is indicated in FIG. 2, the control unit 59 controls the fifth controllable valve 53 to be open between 180° and 360°, the pressurized water exiting the fluid conduit 3 through the second controllable valve 47 enters the cylinder 39 through the fifth controllable valve 53 to push the piston 37 radially outwards in the cylinder 39.

From 270° to 360°, the control unit 59 controls the first controllable valve 45 to open to allow pressurized water, with higher pressure, to flow from the fluid conduit 3, via the fluid separator 41, to the first fluid returning conduit 23 through the first controllable valve 45, to enter the cylinder 39 through the fifth controllable valve 53 to continue to push the piston 37 radially outwards in the cylinder 39.

It should be noted that the fluid returning arrangement 19 in the apparatus 1 in FIG. 1 may comprise additional piston arrangements 21 and/or other configurations of the pressure reducing arrangement. Several piston arrangements could for example enable a smoother flow of the returning depressurizing second fluid. One example of an alternative way of depressurizing the pressurized second fluid will be described below with reference to FIG. 3.

Figure 3:
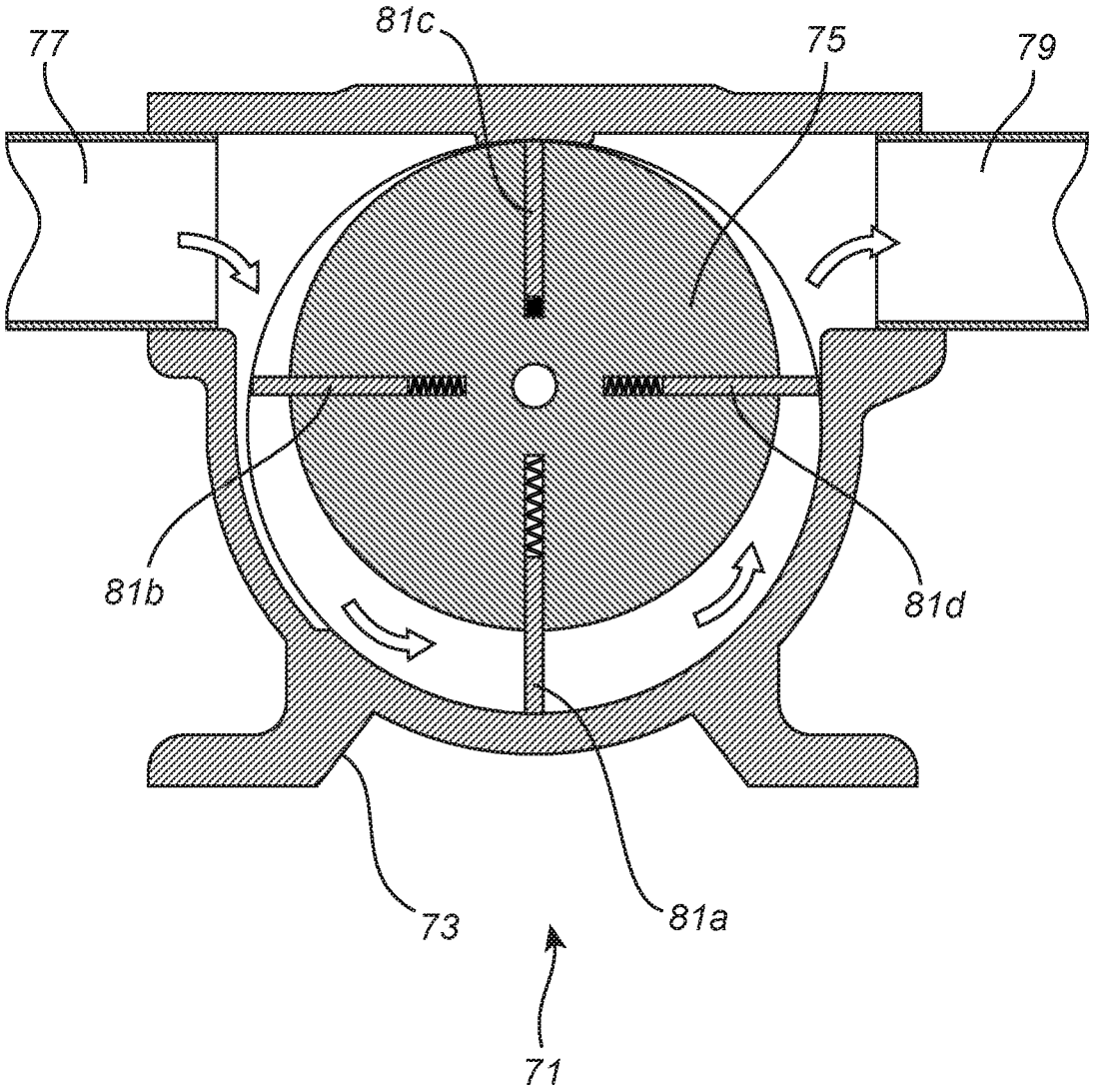
FIG. 3 is a schematic illustration of a rotary alternative to the piston in FIG. 1.

Referring to FIG. 3, a so-called displacement pump 71 may be used as an alternative to the piston arrangement 21 in FIG. 1. As is schematically indicated in FIG. 3, the, per se well-known, displacement pump 71 comprises a housing 73, a rotor 75, an inlet port 77, and an outlet port 79. As can be seen in FIG. 3, the rotor 75 is arranged off-center in the housing 73, and is provided with spring-loaded vanes 81*a-d*.

To replace the piston arrangement 21 in FIG. 1, the housing 73 may be allowed to rotate with the fluid conduit 3 (like the cylinder 39 in FIG. 1), and the rotor 75 may be fixed no a non-rotating part of the apparatus 1 in FIG. 1. The first fluid returning conduit 23 may be connected to the inlet port 77 and the second fluid returning conduit 29 may be connected to the outlet port 79 of the displacement pump 71.

Figure 4A:
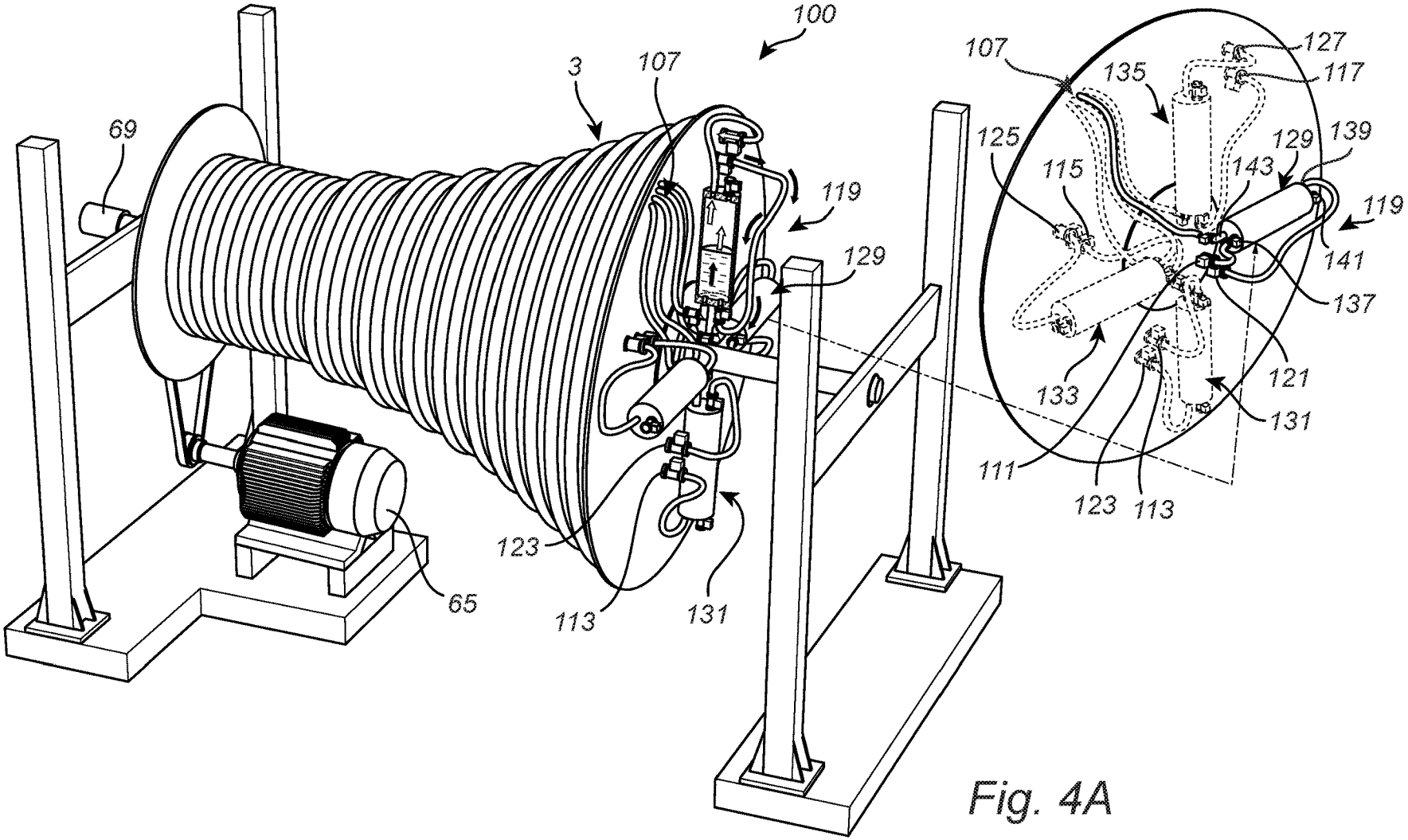
FIGS. 4A-B are schematic perspective views of an apparatus according to a second example embodiment of the present invention.
Figure 4B:
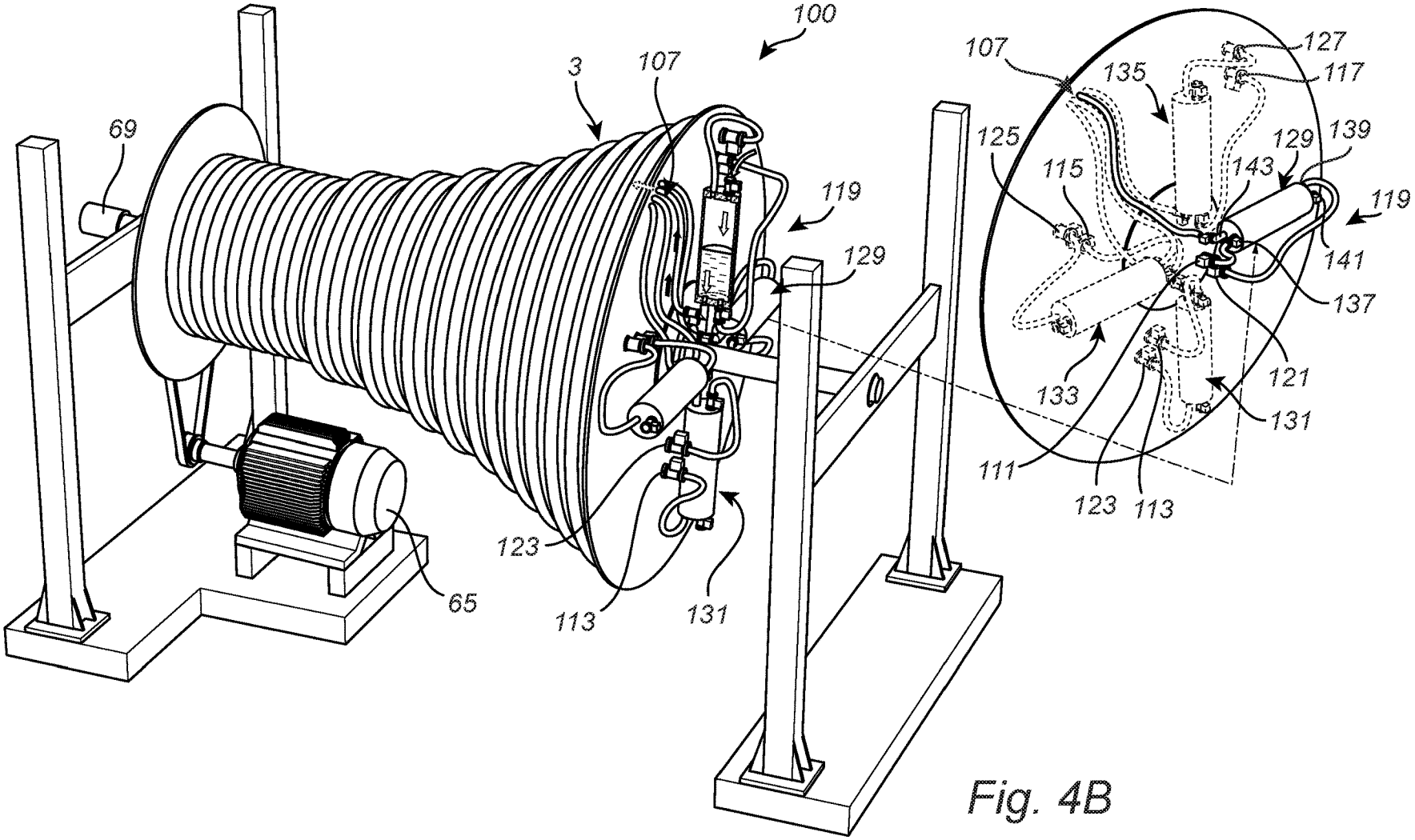

FIGS. 4A-B schematically illustrate an apparatus according to a second example embodiment of the present invention, in the form of a free-standing compressor/air motor 100. The compressor/air motor 100 is an apparatus that can operate in two modes of operation: a first mode in which rotation is converted to fluid (air) flow; and a second mode in which flow of pressurized fluid (air) is converted to rotation.

The above-mentioned first mode of operation will be described in detail here. The above-mentioned second mode of operation simply involves running the apparatus "backwards" as compared to the first mode of operation. This means that some fluid ports that are "inlets" in the first mode will be "outlets" in the second mode, and vice versa. This also means that an electric motor in the first mode of operation is an electric generator in the second mode of operation. In addition to running the apparatus "backwards", various other minor adjustments may be required and/or beneficial. Given the description provided herein, such minor adjustments will, however, be well within the capabilities of one of ordinary skill in the art.

The apparatus 100 according to the second embodiment shown in FIGS. 4A-B mainly differs from the apparatus 1 according to the first embodiment shown in FIG. 1 in the configuration of the fluid returning arrangement 119.

As is schematically shown in FIGS. 4A-B, the fluid conduit 3 has a first outlet and a second outlet in the form of a common outlet 111 (the common outlet 111 corresponds to the common outlet 11 in FIG. 1, where it is easier to see) for output of pressurized first fluid (such as air) and pressurized second fluid (such as water). In the following, the terms "air" and "water" will be used. It should, however, be understood that the first and second fluids need not be air and water, as was explained further above.

In addition to the first inlet and second inlet, here provided as common inlet 107, the fluid conduit 3 in the apparatus 100 in FIGS. 4A-B has a third outlet 113 for output of water, a fourth outlet 115 for output of water, and a fifth outlet 117 for output of water. As is schematically indicated in FIGS. 4A-B, the third outlet 113 is arranged along the fluid conduit 3 between the common outlet 111 and the common inlet 107, the fourth outlet 115 is arranged between the third outlet 113 and the common inlet 107, and the fifth outlet 117 is arranged between the fourth outlet 115 and the common inlet 107.

The fluid conduit 3 in the apparatus 100 in FIGS. 4A-B further has a third inlet 121 for receiving air into the fluid conduit 3, a fourth inlet 123, a fifth inlet 125, and a sixth inlet 127. The third inlet 121 is arranged along the fluid conduit 3 between the common outlet 111 and the third outlet 113, the fourth inlet 123 is arranged between the third inlet 121 and the common inlet 107, the fifth inlet 125 is arranged between the fourth inlet 123 and the common inlet 107, and the sixth inlet 127 is arranged between the fifth inlet 125 and the common inlet 107.

As is indicated in FIGS. 4A-B, the apparatus 100 further comprises a first container 129, a second container 131, a third container 133, and a fourth container 135. Each of these containers is used to return pressurized water, while depressurizing the water. Energy carried by the pressurized water is used for pressurizing air, and this pressurized air is injected at suitable locations along the fluid conduit 3 in order to restore the desired proportions between the alternating portions of (compressible) air and (incompressible) water along the fluid conduit 3. When the pressurized water has been used for pressurizing and injecting air as described above, the depressurized water is provided to the common inlet 107.

The functionality of the pressure reducing arrangement 119 in the second embodiment of the apparatus 100 in FIGS. 4A-B will be described for one stage, involving the first container 129. The functionality of each of the other stages is identical or similar, and a detailed description thereof will therefore be omitted.

The first container 129 has a first container inlet 137, a first container outlet 139, a second container inlet 141, and a second container outlet 143. As is schematically indicated in FIGS. 4A-B, the first container inlet 137 is connected to the common outlet 111, the first container outlet 139 is connected to the third inlet 121, the second container outlet 143 is connected to the common inlet 107, and the second container inlet 141 is connected to the atmosphere via a check valve. The first container outlet 139 may also be provided with a check valve, and the first container inlet 137 and the second container outlet 143 may be provided with controllable valves. Obviously, the choice of flow control devices for controlling flow into and out of the containers, and the control of the flow control devices may depend on the particular application, and it will be straight-forward for one of ordinary skill in the art to select suitable flow control devices and establish a control sequence for the flow control devices, if applicable, based on the description provided herein.

In operation, the first container inlet 137 is opened during a suitable time period to receive pressurized water into the first container 129 from the common outlet 111. The pressurized water (indicated by solid arrows in FIG. 4A) entering the first container 129 is used to pressurize air and inject the pressurized air (indicated by unfilled arrows in FIG. 4A) into the fluid conduit 3 through the third inlet 121 of the fluid conduit. This suitable time period may be selected to be a time when water comes out of the common outlet 111 and pressurized air is added to an existing air portion in the fluid conduit 3 at the third inlet 121. Once the first container 129 has been filled with water, the first container outlet 139 is closed, and the second container outlet 143 is opened to allow the water in the first container 129 to be sucked into the common inlet 107 of the fluid conduit 3. The water sucked out of the first container 129 is replaced with air entering the first container 129 through the second container inlet 141. When all the water has been removed from the first container 129, and before it is time for the first container 129 to receive pressurized water again, air may be sucked into the common inlet 107 of the fluid conduit 3 via the second container inlet 141.

FIG. 4A schematically indicates the first part of the sequence described above, in which pressurized water enters the container, and pressurizes and injects air into the fluid conduit. FIG. 4B schematically shows the second part of the sequence, in which depressurized water is sucked into the common inlet 107 of the fluid conduit, and air at atmospheric pressure enters the container.

The person skilled in the art realizes that the present invention by no means is limited to the preferred embodiments described above. On the contrary, many modifications and variations are possible within the scope of the appended claims. For example, the fluid returning arrangement 19 may comprise a flow and/or pressure stabilization reservoir. The fluid returning arrangement 19 could be equipped with several check valves in sequence to enable a better flow control. It is also possible to use several fluid returning arrangements 19 in parallel or to have several outlet/inlets connected to the same container. One could also have several piston arrangements in parallel, which may, for example, be connected to different outlets. This may enable operation with fewer controllable flow-control devices, or completely without controllable flow-control devices.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. Any reference signs in the claims should not be construed as limiting the scope.

What is claimed is:

1. An apparatus for converting rotation to fluid flow, comprising:

a fluid conduit coiled around a rotational axis, said fluid conduit having a first inlet for receiving a first fluid having a first density and a second inlet for receiving a second fluid having a second density, different from said first density, and a first outlet for output of said first fluid and a second outlet for output of said second fluid;

said fluid conduit being rotatable around said rotational axis in a first angular direction such that first fluid portions of said first fluid and second fluid portions of said second fluid are transported along said fluid conduit towards said first outlet, while being pressurized; and a motor coupled to said fluid conduit to rotate said fluid conduit around said rotational axis in a first angular direction such that first fluid portions of said first fluid and said second fluid portions of second fluid are transported along said fluid conduit towards said first outlet, while being pressurized; and a fluid returning arrangement, fluid flow connecting said second outlet and said second inlet for selectively allowing pressurized second fluid to return from said second outlet to said second inlet, while depressurizing said pressurized second fluid.

2. The apparatus according to claim 1, wherein said fluid returning arrangement comprises a pressure reducing arrangement including an actuator, said pressure reducing arrangement being configured to:

receive said pressurized second fluid;

cause said pressurized second fluid to perform work on said actuator, resulting in movement of said actuator, to thereby be depressurized; and output depressurized second fluid.

3. The apparatus according to claim 2, wherein said fluid returning arrangement comprises a fluid returning conduit, said actuator being arranged to move in relation to said fluid returning conduit as a result of interaction with said second fluid.

4. The apparatus according to claim 2, further comprising a conversion arrangement coupled to said actuator and configured to convert the movement of said actuator to rotation of said fluid conduit in said first angular direction.

5. The apparatus according to claim 4, said conversion arrangement mechanically coupling said actuator to said fluid conduit in such a way that the movement of said actuator results in rotation of said fluid conduit in said first angular direction.

6. The apparatus according to claim 2, wherein said pressure reducing arrangement comprises at least one of a turbine, a pump, and a piston.

7. The apparatus according to claim 1, wherein said fluid returning arrangement comprises a pressure reducing arrangement including an actuator, said pressure reducing arrangement being configured to:

receive said pressurized second fluid;

cause said pressurized second fluid to perform work on said actuator, resulting in movement of said actuator, to thereby be depressurized; and output depressurized second fluid, wherein said apparatus further comprises a conversion arrangement coupled to said actuator and configured to convert the movement of said actuator to rotation of said fluid conduit in said first angular direction.

8. The apparatus according to claim 1, wherein said apparatus further comprises a first flow-control device controllable to prevent or allow fluid flow between said fluid conduit and said fluid returning arrangement through said second outlet.

9. The apparatus according to claim 8, wherein:

said first flow-control device is an electrically controllable flow-control device; and said apparatus further comprises control circuitry having an input for receiving a signal indicative of an angular position of said second outlet, and at least a first output for providing a first control signal to said flow-control device to allow flow from said fluid conduit to said fluid returning arrangement through said second outlet when said second outlet is within a predetermined first angular range.

10. The apparatus according to claim 8, wherein:

said first flow-control device is a mechanically actuated flow-control device; and said apparatus further comprises an actuation device arranged to move in response to rotation of said fluid conduit, and to interact with said first flow-control device to allow flow from said fluid conduit to said fluid returning arrangement through said second outlet when said second outlet is within a predetermined first angular range.

11. The apparatus according to claim 1, wherein said fluid returning arrangement comprises a fluid returning conduit connected to said second inlet.

12. The apparatus according to claim 1, wherein said fluid conduit further has a third inlet, arranged along said fluid conduit between said second inlet and said second outlet, for receiving first fluid.

13. An apparatus for converting fluid flow into rotation, comprising: a fluid conduit coiled around a rotational axis, said fluid conduit having a first inlet for receiving first fluid having a first density and a second inlet for receiving second fluid having a second density, different from said first density, and a first outlet for output of said first fluid and a second outlet for output of said second fluid, wherein said apparatus is configured in such a way that supply of pressurized first fluid portions to said first inlet and supply of pressurized second fluid portions to said second inlet causes said fluid conduit to rotate around said rotational axis and transport said first and second fluid portions towards said first outlet, while being depressurized; and wherein said apparatus further comprises a fluid returning arrangement, fluid flow connecting said second outlet and said second inlet for selectively allowing depressurized second fluid to return from said second outlet to said second inlet, while pressurizing said depressurized second fluid.

14. The apparatus according to claim 13, wherein said fluid returning arrangement comprises a pressurizing arrangement including an actuator, said pressurizing arrangement being configured to:

receive said depressurized second fluid;

convert movement of said actuator to work acting on said second fluid to pressurize said second fluid; and output pressurized second fluid, wherein said apparatus further comprises a conversion arrangement coupled to said actuator and configured to convert rotation of said fluid conduit to movement of said actuator.

15. The apparatus according to claim 13, wherein said fluid conduit further has a third inlet, arranged along said fluid conduit between said first inlet and said first outlet, for receiving said second fluid.

* * * * *